US009741500B1

(12) United States Patent
Seo

(10) Patent No.: US 9,741,500 B1
(45) Date of Patent: Aug. 22, 2017

(54) TERMINAL CONNECTING MECHANISM FOR MOLDED CASE CIRCUIT BREAKER

(71) Applicant: LSIS CO., LTD., Anyang-si, Gyeonggi-do (KR)

(72) Inventor: Insu Seo, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 15/406,697

(22) Filed: Jan. 14, 2017

(30) Foreign Application Priority Data

Apr. 4, 2016 (KR) ..... 10-2016-0041220

(51) Int. Cl.

| | |
|---|---|
| ***H01R 4/48*** | (2006.01) |
| ***H01H 1/58*** | (2006.01) |
| ***H01H 71/08*** | (2006.01) |
| *H01R 101/00* | (2006.01) |

(52) U.S. Cl.
CPC ..... *H01H 1/5844* (2013.01); *H01H 71/08* (2013.01); *H01R 4/4863* (2013.01); *H01R 2101/00* (2013.01)

(58) Field of Classification Search
CPC ..... H01R 11/12
USPC ..... 439/729, 822, 819, 864
See application file for complete search history.

(56) References Cited

U.S. PATENT DOCUMENTS 2,705,787 A * 4/1955 Benander ..... H01R 24/76 439/650
3,319,215 A * 5/1967 Moore ..... G01K 7/023 374/E7.005
3,604,876 A * 9/1971 Pasbrig ..... H01R 9/22 200/275
4,759,726 A * 7/1988 Naylor ..... H01R 4/5008 439/441
6,416,350 B1 * 7/2002 Harting ..... H01R 12/68 439/422

(Continued)

FOREIGN PATENT DOCUMENTS

| | | |
|---|---|---|
| JP | 1993-73858 | 10/1993 |
| JP | 3355161 | 12/2002 |
| JP | 2005353381 | 12/2005 |

(Continued)

OTHER PUBLICATIONS

Korean Intellectual Property Office Application No. 10-2016-0041220, Search report dated Apr. 22, 2016, 4 pages.

*Primary Examiner* — Phuong Dinh
(74) *Attorney, Agent, or Firm* — Lee, Hong, Degerman, Kang & Waimey

(57) ABSTRACT

A terminal connecting mechanism for a molded case circuit breaker that does not need a tool for connection or release between a wire and a terminal is disclosed. The terminal connecting mechanism of a molded case circuit breaker comprises a supporter having a through hole portion for allowing passing through of a terminal of the molded case circuit breaker and a terminal seat portion where the terminal, which has passed through the through hole portion, is mounted; a spring of which one end is supported by the supporter; and a lever member being in contact with the other end of the spring, rotataby moving to a position for allowing insertion of a wire to contact the terminal, and pressurizing the wire by means of an elastic force of the spring to maintain a contact state between the wire and the terminal.

7 Claims, 8 Drawing Sheets

(56) References Cited

U.S. PATENT DOCUMENTS 8,870,608 B2 * 10/2014 Weiden ..... H01R 4/4818
439/811

FOREIGN PATENT DOCUMENTS

| | | |
|---|---|---|
| JP | 2007095556 | 4/2007 |
| KR | 1990-0004068 | 5/1990 |
| KR | 2007149584 | 6/2007 |

* cited by examiner

TERMINAL CONNECTING MECHANISM FOR MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2016-0041220, filed on Apr. 4, 2016, the contents of which are all hereby incorporated by reference herein in its entirety.

BACKGROUND OF THE INVENTION

1. Field of the Invention

The present invention relates to a molded case circuit breaker, and more particularly, to a terminal connecting mechanism for a molded case circuit breaker that can connect a terminal of the molded case circuit breaker with a wire even without any tool.

2. Description of the Related Art

An example of a terminal connecting mechanism of a molded case circuit breaker according to the related art will be described with reference to FIG. 1.

As seen with reference to FIG. 1, a molded case circuit breaker 100 according to the related art includes two terminal portions 10 each of which can be connected with a wire W of an electric power source side or an electric load side.

One terminal portion 10 of the two terminal portions 10 is provided with three terminals 1 for three-phases alternating current, which are arranged to be exposed.

In the terminal portion 10, guide rail portions 2 to which connecting groove portions provided at both sides of a lug seat 3 may be inserted are provided below the three terminals 1.

The terminal connecting mechanism for the molded case circuit breaker according to the related art includes three lug assemblies provided to correspond to the three terminals 1.

Each of the lug assemblies includes a lug 4, a lush seat 3, and a binding screw 5.

The lug 4 is a means for providing a connecting place where the wire W is connected with the terminals 1, and is a hexagonal hollow rigid component and has front and rear surfaces opened to allow entrance of the wire W and the terminals 1 and an upper surface provided with a screw hole portion (no reference numeral) for supporting screw meshing and ascending and descending of the binding screw 5.

The lug seat 3 supports the lug 4 from below, and is provided as a means for leveling a height of the terminals 1 and a height of the inner bottom surface of the lug 4.

The lug seat 3 has connecting groove portions concavely formed at both sides, and may be mounted in the molded case breaker 100 by fitting the corresponding groove portions to the guide rail portions 2 of the terminal portion 10.

A tool connecting groove portion to which a screw driver or wrench may be connected may be provided at a head part of the binding screw 5, and is provided with a screw portion at a lower portion of the binding screw 5.

The binding screw 5 is meshed to the screw hole portion provided on the upper surface of the lug 4 to ascend and descend.

When the binding screw 5 is descending by means of connection and manipulation of the tool, the binding screw 5 may act to maintain an electrical connecting state between the wire W and the terminals 1 by pressurizing the wire W arranged on the terminals 1 inside the lug 4.

When the binding screw 5 is ascending by means of connection and manipulation of the tool, the binding screw 5 may detach the wire W from the lug 4 by releasing the wire W arranged on the terminals 1 inside the lug 4 to release the electrical connecting state between the wire W and the terminals 1.

However, the aforementioned terminal connecting mechanism for the molded case circuit breaker according to the related art has a problem in that a tool such as screw driver or wrench is necessarily required for connection and release between the wire and the terminals.

SUMMARY OF THE INVENTION

Therefore, the present disclosure is to solve the aforementioned problems. An object of the present disclosure is to provide a terminal connecting mechanism of a molded case circuit breaker that does not need a tool for connection and release between a wire and a terminal.

To achieve these and other objects and in accordance with the purpose of the present disclosure, as embodied and broadly described herein, according to the present disclosure, a terminal connecting mechanism for a molded case circuit breaker, comprises a supporter that has a through hole portion for allowing passing through of a terminal of the molded case circuit breaker and a terminal seat portion where the terminal, which has passed through the through hole portion, is mounted; a spring that one end of the spring is supported by the supporter; and a lever member that is in contact with the other end of the spring, rotatable to a position for allowing insertion of a wire to contact the terminal, and pressurizes the wire by means of an elastic force of the spring to maintain a contact state between the wire and the terminal, wherein the lever member has a spring supporting seat portion for supporting the other end of the spring, the supporter has a spring supporting seat portion for supporting one end of the spring, and the spring supporting seat portion of the supporter is located at a height higher than a height of the spring supporting seat portion of the lever member at an assembly state.

According to one preferred aspect of the present disclosure, the lever member comprises a manipulation protruding portion formed to be more protruded toward the front than the other front portions of the lever member.

According to another preferred aspect of the present disclosure, the lever member comprises a plurality of grooved portions at an upper portion of one surface.

According to still another preferred aspect of the present disclosure, the lever member comprises a surface having the spring supporting seat portion, which has a first inclined surface of an upper portion and a second inclined surface of a lower portion based on the spring supporting seat portion, and the first inclined surface and the second inclined surface are formed concavely toward the spring supporting seat portion.

According to still another preferred aspect of the present disclosure, the supporter comprises the terminal seat portion that provides a mounting space for the terminal and has a bottom portion and both sidewall portions formed to be extended from both sides of the bottom portion at a predetermined height; a vertical wall portion that is formed to be upwardly extended from the rear of the bottom portion and has a spring supporting seat portion for supporting one end of the spring at a predetermined position; and the through hole portion that is provided at the vertical wall portion and allows passing through of the terminal.

According to still another preferred aspect of the present disclosure, the supporter further comprises a pair of extension protrusions that are provided to be extended from both sidewall portions of the terminal seat portion towards the facing sidewall portions to prevent the lever member from being detached from the supporter.

According to still another preferred aspect of the present disclosure, the lever member comprises a wire receiving portion that receives a wire on a lower surface and the wire receiving portion is configured with a concave groove portion or "V" type groove portion formed to be concaved upwardly.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Advantages and features of the present invention, and implementation methods thereof will be clarified through following embodiments described with reference to the accompanying drawings.

Figure 1:
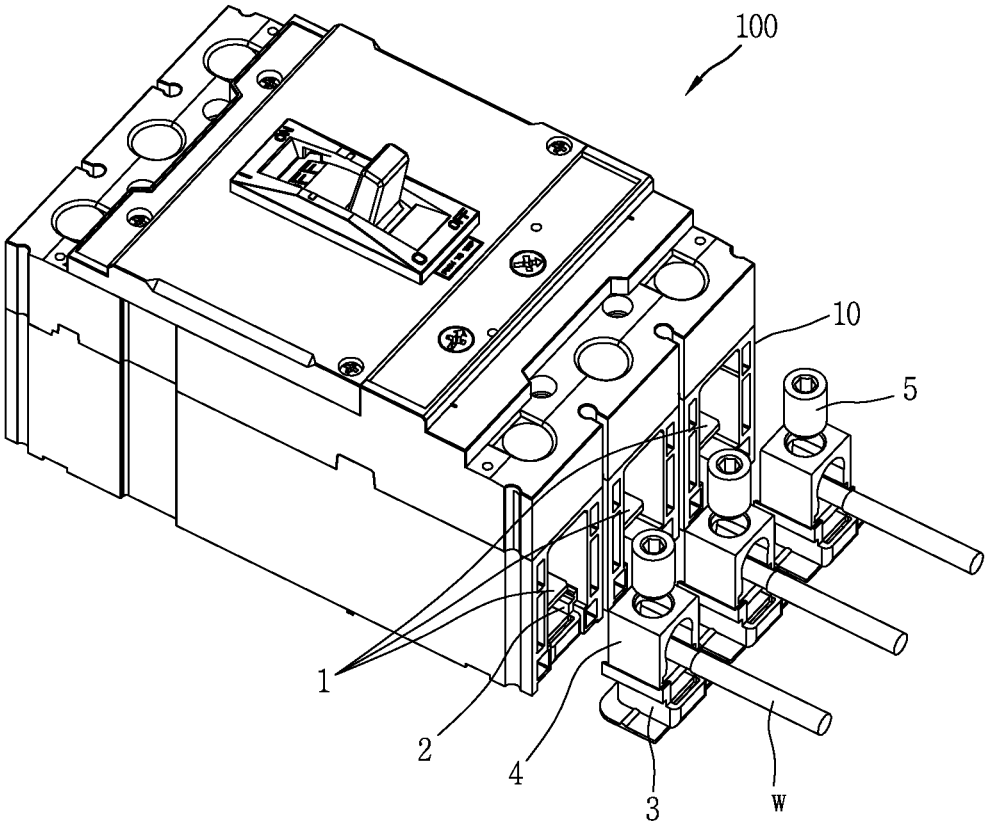
FIG. 1 PRIOR ART
FIG. 1 is an exploded perspective view of a molded case circuit breaker and a terminal connecting mechanism illustrating a configuration of a terminal connecting mechanism of a molded case circuit breaker according to the related art.
Figure 2:
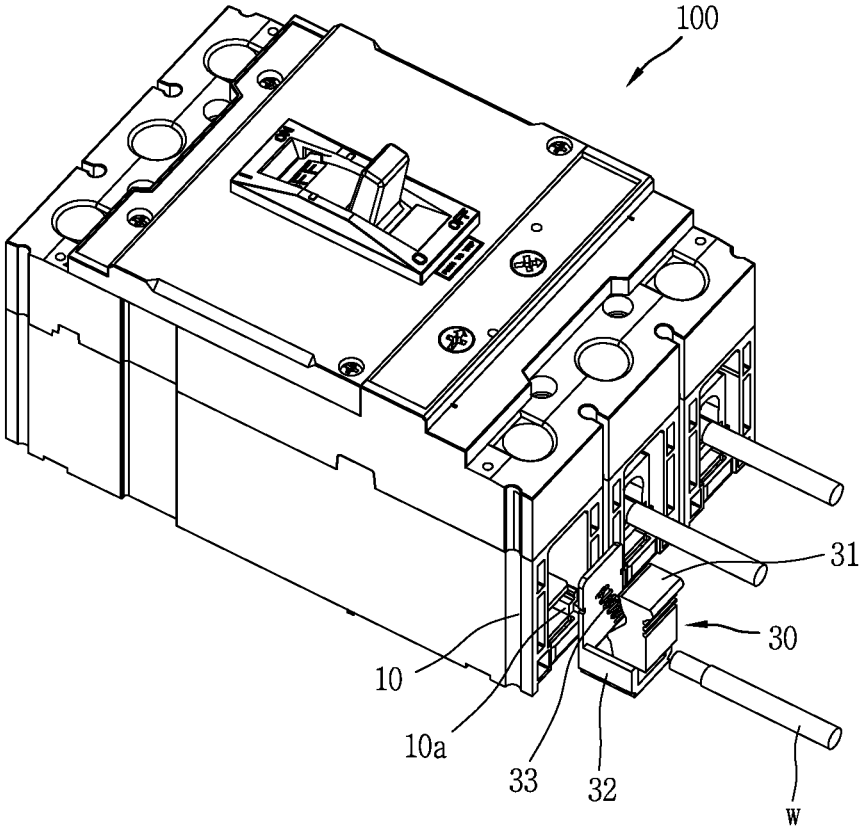
FIG. 2 is an exploded perspective view of a terminal connecting mechanism and a molded case circuit breaker according to the preferred embodiment of the present invention.

As seen with reference to FIG. 2, a terminal connecting mechanism 30 according to the preferred embodiment of the present invention comprises a supporter 32, a spring 33, and a lever member 31.

As seen with reference to FIG. 2, the terminal connecting mechanisms 30 according to the preferred embodiment of the present invention are provided at both ends in a length direction of a molded case circuit breaker 100 and can be installed at a terminal portion 10 that can be connected with a wire W as a circuit line at an electric power source side or an electric load side.

Figure 4:
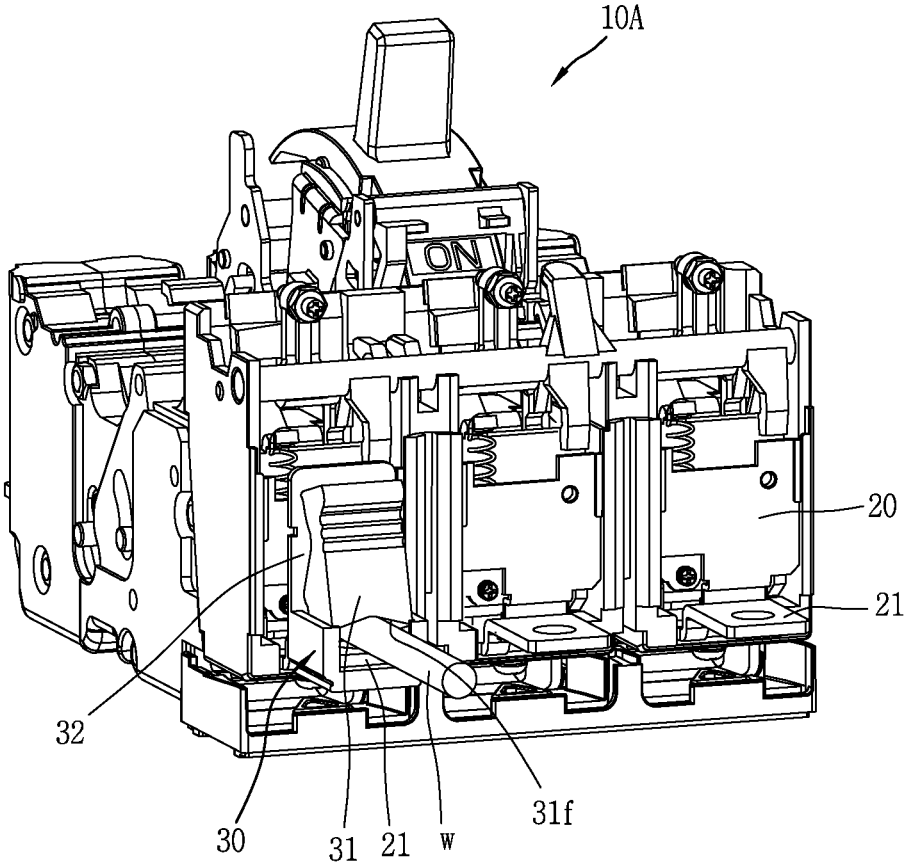
FIG. 4 is a perspective view illustrating an assembly state of a terminal connecting mechanism according to the preferred embodiment of the present invention and a switching mechanism of a molded case circuit breaker.

In FIG. 4, a reference numeral 10A designates a switching mechanism for driving a movable contact arm as well-known, and that comprises a trip spring, a shaft, an upper link, a lower link, a latch, a handle, a lever, etc.

Figure 5:
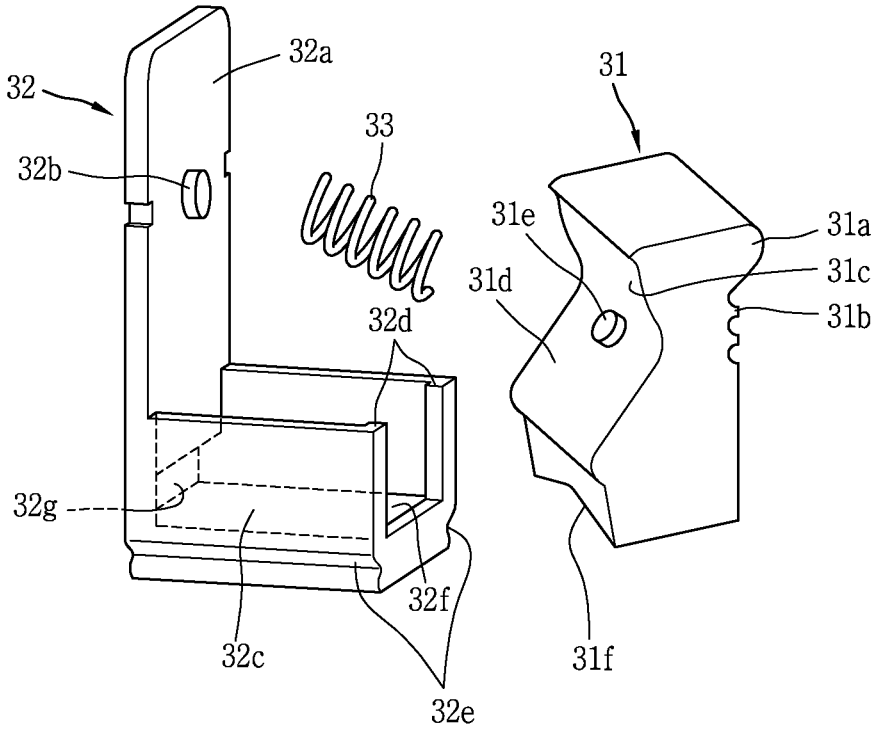
FIG. 5 is an exploded perspective view illustrating a terminal connecting mechanism according to the preferred embodiment of the present invention.

As seen with reference to FIG. 5, the supporter 32 has a through hole portion 32*g* and terminal seat portions 32*f* and 32*c*.

The through hole portion 32*g* is a portion that allows to pass through a terminal of the molded case circuit breaker, and the terminal seat portions 32*f* and 32*c* are portions where the terminals (see reference numeral 21 of FIG. 3), which have passed through the through hole portion are mounted.

In accordance with one preferred aspect of the present invention, as seen with reference to FIG. 5, the supporter 32 comprises the terminal seat portions 32*f* and 32*c*, a vertical wall portion 32*a*, and the through hole portion 32*g*.

Figure 3:
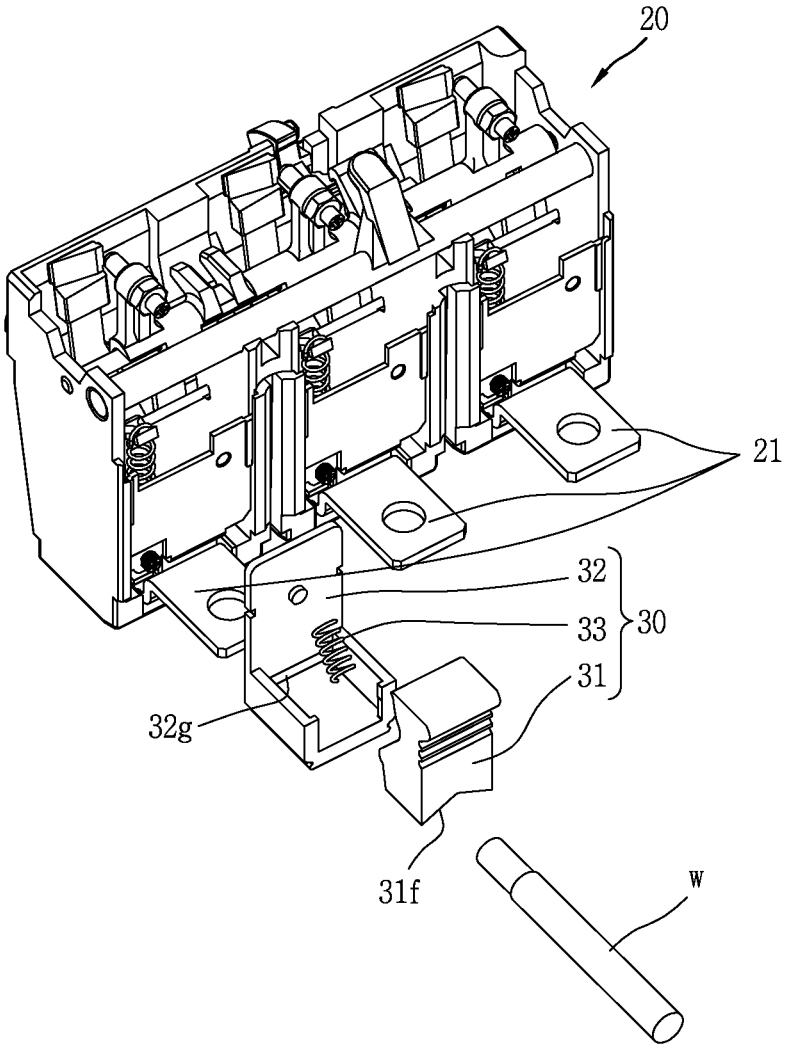
FIG. 3 is an exploded perspective view of a trip mechanism of a molded case circuit breaker and a terminal connecting mechanism according to the preferred embodiment of the present invention.

The terminal seat portions 32*f* and 32*c* are formed by a bottom portion 32*f* and both sidewall portions 32*c* extended at a predetermined height from both sides of the bottom portion 32*f*, and provides a mounting space of the terminals (see reference numeral 21 of FIG. 3).

In accordance with another preferred aspect of the present invention, as seen with reference to FIG. 5, the supporter 32 has a spring supporting seat portion 32*b* for supporting one end of the spring 33, and in the assembly state as described with reference to FIG. 7, the spring supporting seat portion 32*b* of the supporter 32 is arranged to be higher than a spring supporting seat portion 31*e* of the lever member 31.

Therefore, as the spring 33 is formed to be inclined, it is advantageous that a vertical component force of an elastic force of the spring 33 acting as the lever member 31 is greater than the case that the spring support portion 32*b* of the supporter 32 is arranged at the same height as that of the spring supporting seat portion 31*e* of the lever member 31.

This is because that the vertical component force of the elastic force of the spring 33 acting as the lever member 31 is a value obtained by multiplying the elastic force by a cosine 8 when an angle between the vertical wall portion 32*a* and the spring 33 is 8 based on the vertical wall portion 32*a* of the supporter 32. This is expressed by the following Equation.

$$F=F\cos\theta \qquad \text{[Equation 1]}$$

In this case, f is the vertical component force of the elastic force F, F is the elastic force of the spring 33, and 8 is the angle between the vertical wall portion 32*a* and the spring 33.

If the spring supporting seat portion 32*b* of the supporter 32 has the same height as that of the spring supporting seat portion 31*e* of the lever member 31, since θ is 90°, cos θ becomes 0 (zero), and if θ is an acute angle greater than 0° and smaller than 90°, cos θ becomes a value greater than 0 (zero) and smaller than 1. Therefore, the vertical component force f of the elastic force F of the spring 33 acting as the lever member 31 becomes greater than the case that the spring supporting seat portion 32*b* of the support member 32 has the same height as that of the spring supporting seat portion 31*e* of the lever member 32*b*.

The vertical wall portion 32*a* is extended from the rear of the bottom portion 32*f* to the top thereof.

As best shown in FIG. 5, the vertical wall portion 32*a* has the spring supporting seat portion 32*b* for supporting one end of the spring 33 at a predetermined position.

The through hole portion 32*g* is provided at the vertical wall portion 32*a* and allows passing through of the terminals (see reference numeral 21 of FIG. 3).

Therefore, the through hole portion 32*g* may be formed to have a clearance wider than a width of the terminal and higher than the height of the terminal to allow passing through of the terminals.

Figure 6:
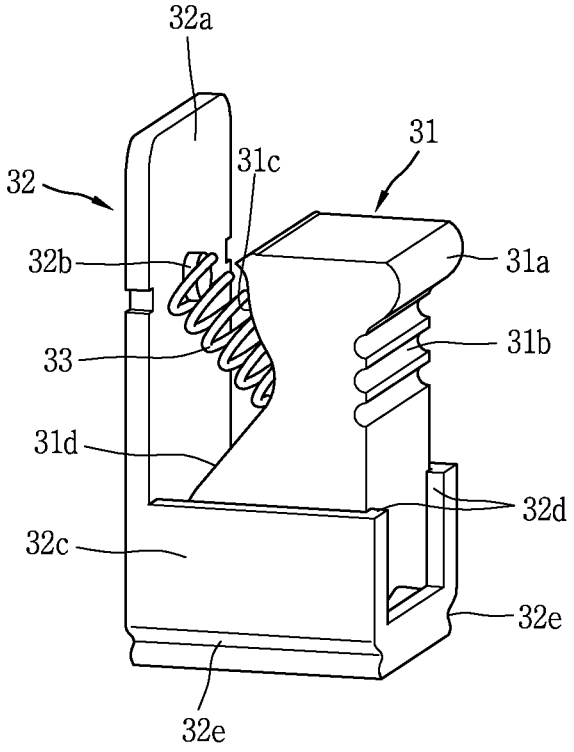
FIG. 6 is a perspective view illustrating an assembly state of a terminal connecting mechanism according to the preferred embodiment of the present invention.

Also, the supporter further comprises a pair of extension protrusions 32*d* as shown in FIG. 5 to FIG. 6.

The pair of extension protrusions 32*d* are provided to be extended from both sidewall portions 32*c* of the terminal seat portion towards the facing sidewall portions 32*c* to prevent the lever member 31 from being detached from the supporter.

Therefore, even though the elastic force of the spring 33 is applied to the lever member 31 in a direction that the lever member 31 is detached from the supporter 32, since the lever member 31 is stopped by the pair of extension protrusions 32*d*, the lever member 31 can be prevented from the supporter 32.

As best shown in FIGS. 5 and 6, the supporter 32 may further include a mounting groove portion 32*e* below both sidewall portions 32*c* of both sides, wherein the mounting groove portion 32*e* can be mounted on a guide rail portion 10*a* provided relatively to be protruded at both insulating partition wall portions of the terminal portion 10 of the molded case circuit breaker 100.

The spring 33 has one end supported by the spring supporting seat portion 32*b* of the supporter 32 and the other end supported by the spring supporting seat portion 31*e* of the lever member 31.

In accordance with the preferred embodiment, the spring 33 can be configured with a compressive spring for charging elastic energy when it is compressed.

The lever member 31 is a means for rotatably moving to a position for allowing insertion of the wire W to contact the terminal 21 and pressurizing the wire W by means of the elastic force of the spring 33 to maintain a contact state between the wire W and the terminal 21.

The lever member 31 has the spring supporting seat portion 31*e* for supporting the other end of the spring as described above with reference to FIG. 5.

Figure 7:
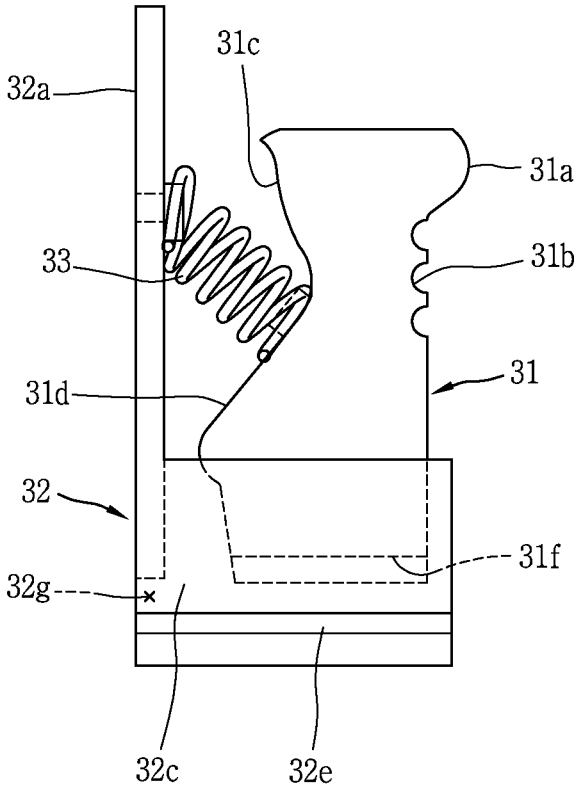
FIG. 7 is a side view illustrating an assembly state of a terminal connecting mechanism according to the preferred embodiment of the present invention.

As best shown in FIG. 7, the lever member 31 comprises a manipulation protruding portion 31*a* formed at an upper portion to be more protruded toward the front than other front portions of the lever member 31.

Figure 8:
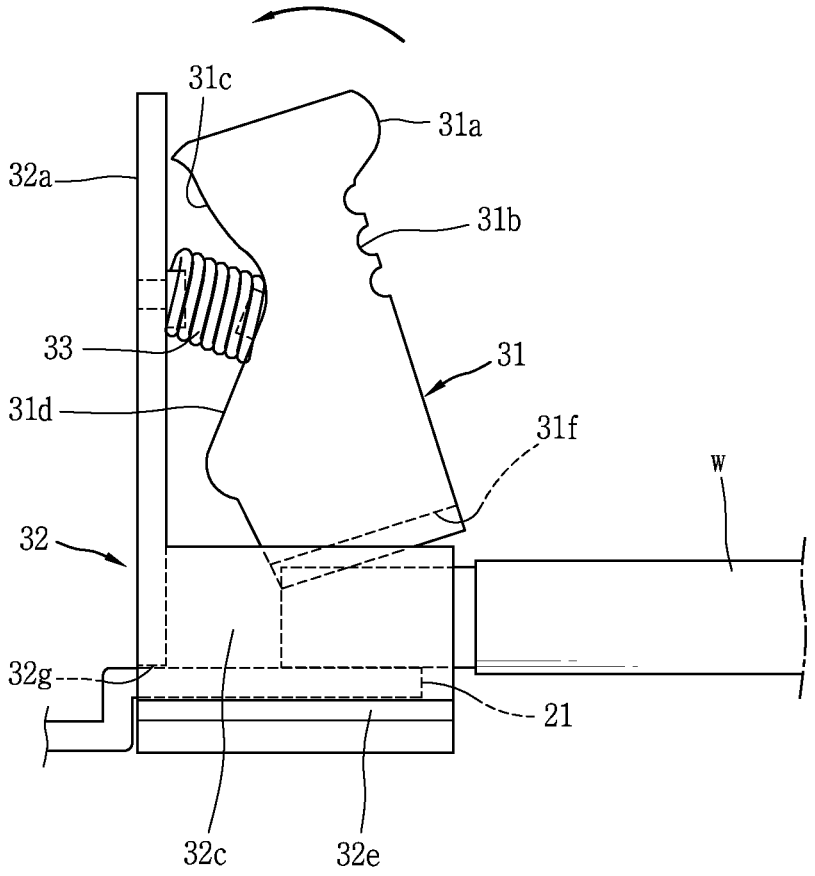
FIG. 8 is an operation state view illustrating an operation state during wire connection of a terminal connecting mechanism according to the preferred embodiment of the present invention.

When the wire W is connected to the terminal 21, if a user rotates the lever member 31 counterclockwise as shown in FIG. 8 by pushing the manipulation protruding portion 31*a* with a finger, the manipulation protruding portion 31*a* is provided as a manipulation means of the lever member 31 for connecting the wire W to the terminal 21, so as to expose a space into which the wire W can be inserted.

Also, if the user rotates the lever member 31 counterclockwise as shown in FIG. 8 by pushing an embossed portion 31*b* provided below the manipulation protruding portion 31*a* with a finger, the manipulation protruding portion 31*a* can serve as a stopper of a touching portion (see a plurality of grooved portions 31*b*) of the lever member 31.

As well seen in FIGS. 5 to 8, the lever member 31 comprises a plurality of grooved portions 31*b* at an upper portion of one surface (a front surface when the surface where the manipulation protruding portion 31*a* is arranged is the front surface).

The grooved portions 31*b* can serve to guide a finger of the user to push the corresponding portion (the grooved portions 31*b*) and prevent a slip from occurring when the user pushes the corresponding portion.

As well seen in FIGS. 5 to 8, a surface (a rear surface when the surface where the manipulation protruding portion 31*a* is arranged is the front surface) having the spring supporting seat portion 31*e* in the lever member 31 comprises a first inclined surface 31*c* of an upper portion and a second inclined surface 31*d* of a lower portion based on the spring supporting seat portion 31*e*.

In accordance with the preferred aspect of the present invention, the first inclined surface 31*c* and the second inclined surface 31*d* are formed concavely toward the spring supporting seat portion 31*e*.

The first inclined surface 31*c* and the second inclined surface 31*d* can serve to prevent the spring 33 from being detached therefrom by allowing the spring 33 to be located within a space formed by the first inclined surface 31*c* and the second inclined surface 31*d* or allowing the spring 33 not to be far away from the first inclined surface 31*c* and the second inclined surface 31*d* even though the spring 33 is detached from the spring supporting seat portions 31*e* and 32*b*.

Also, the lever member 31 may include a wire receiving portion for receiving the wire on a lower surface in accordance with the embodiment, wherein the wire receiving portion may be provided as a concave groove portion or "V" type groove portion 31*f* formed to be concaved upwardly.

Meanwhile, an assembly method of the aforementioned terminal connecting mechanism 30 of the molded case circuit breaker according to the preferred embodiment of the present invention will be described with reference to the drawings.

First of all, as seen with reference to FIG. 3, the supporter 32, the spring 33 and the lever member 31, which are previously manufactured, are prepared.

A user or worker mounts the lever member 31 on the terminal seat portions 32*f* and 32*c* of the supporter 32.

Then, the user or worker mounts both ends of the spring 33 to be supported by the spring supporting seat portions 32*b* and 31*e* of the supporter 32 and the lever member 31 by using a tool such as a pincette or gripping the spring 33 with a finger.

As a result, the assembly of the terminal connecting mechanism 30 is completed.

Next, as seen with reference to FIG. 2, the mounting groove portion 32*e* of the assembled terminal connecting mechanism 30 is pushed to be fitted onto the guide rail portions 10*a* provided at a lower portion of the terminal portion 10 of the molded case circuit breaker 100.

At this time, the terminal 21 of the molded case circuit breaker 100 is located on the bottom portion 32*f* of the terminal seat portions 32*f* and 32*c* by passing through the through hole portion 32*g* of the supporter 32 as can be aware of it with reference to FIG. 8.

The operation of installing the assembled terminal connecting mechanism 30 in the molded case circuit breaker 100 is completed by being performed six times to correspond to a total of 6 corresponding to three electric power source sides and three electric load sides in case of the three-phases molded case circuit breaker.

Also, action of the aforementioned terminal connecting mechanism 30 of the molded case circuit breaker according to the preferred embodiment of the present invention, that is, action when the wire is connected to the terminal or detached from the terminal will be described with reference to FIGS. 7 and 8.

First of all, the connection operation will be described.

The user pushes the manipulation protruding portion 31*a* or the grooved portions 31*b* of the lever member 31 of the terminal connecting mechanism 30 by using a finger.

Then, as the lever member 31 is rotated counterclockwise by overcoming the elastic force of the spring 33, a gap is generated between the terminal 21 and the bottom surface of the lever member 31, and the wire W is pushed into the corresponding gap.

Afterwards, if the lever member 31 is released, the vertical component force of the elastic force of the spring 33 is applied to the wire W through the lever member 31.

Since the vertical component force acts as a maintaining force for maintaining a contact state between the wire W and the terminal 21, the state that the wire W is in contact with the terminal 21 is maintained.

Next, the detachment operation will be described.

In the same manner as the connection operation, the user pushes the manipulation protruding portion 31*a* or the grooved portions 31*b* of the lever member 31 of the terminal connecting mechanism 30 by using a finger.

Then, as the lever member 31 is rotated counterclockwise by overcoming the elastic force of the spring 33, a frictional area of the lever member 31 downwardly pushing the wire W is minimized.

At this time, if the user pulls the wire W in a direction opposite to the direction of the connection operation, the detachment operation is completed.

As described above, since the terminal connecting mechanism for the molded case circuit breaker according to the present invention comprises a supporter having a terminal seat portion where the terminal, a spring of which one end is supported by the supporter, and a lever member having a spring supporting seat portion for supporting the other end of the spring, rotataby moving to a position for allowing insertion of a wire to contact the terminal, and pressurizing the wire by means of an elastic force of the spring to maintain a contact state between the wire and the terminal, connection and detachment of the wire can be performed by push of the lever member without tool, and the electrical connection state between the wire and the terminal can be maintained by the elastic of the spring.

In the terminal connecting mechanism for the molded case circuit breaker according to the present invention, since the lever member comprises a manipulation protruding portion formed to be more protruded toward the front than the other front portions of the lever member, the user can rotatably move the lever member to the position for allowing insertion of the wire by griping the corresponding manipulation protruding portion and pushing the lever member.

In the terminal connecting mechanism for the molded case circuit breaker according to the present invention, since the supporter has a spring supporting seat portion for supporting one end of the spring and the spring supporting seat portion of the supporter is located at a height higher than that of the spring supporting seat portion of the lever member at an assembly state, the spring is formed to be inclined, whereby it is advantageous that the vertical component force of an elastic force of the spring acting as the lever member is greater than the case that the spring support portion of the supporter is arranged at the same height as that of the spring supporting seat portion of the lever member.

In the terminal connecting mechanism for the molded case circuit breaker according to the present invention, since the lever member comprises a plurality of grooved portions at an upper portion of one surface, the grooved portions may serve to guide a finger of the user to push the corresponding portion and prevent a slip from occurring when the user pushes the corresponding portion.

In the terminal connecting mechanism for the molded case circuit breaker according to the present invention, since the lever member comprises a surface having the spring supporting seat portion, which has a first inclined surface of an upper portion and a second inclined surface of a lower portion based on the spring supporting seat portion, and the first inclined surface and the second inclined surface are formed concavely toward the spring supporting seat portion, the first inclined surface and the second inclined surface can serve to prevent the spring from being detached therefrom by allowing the spring to be located within a space formed by the first inclined surface and the second inclined surface or allowing the spring not to be far away from the first inclined surface and the second inclined surface even though the spring is detached from the spring supporting seat portions.

In the terminal connecting mechanism for the molded case circuit breaker according to the present invention, since the supporter comprises a bottom portion, a terminal seat portion, a vertical wall portion having the spring supporting seat portion, and the through hole portion provided at the vertical wall portion, allowing passing through of the terminal, the terminal can be mounted on the terminal seat portion by passing through the through hole portion, and one end of the spring can be supported by the spring supporting seat portion of the vertical wall portion.

In the terminal connecting mechanism for the molded case circuit breaker according to the present invention, since the supporter further comprises a pair of extension protrusions provided to be extended from both sidewall portions of the terminal seat portion towards the facing other sidewall portions, the lever member can be prevented from being detached from the supporter even though the elastic force of the spring is applied to the lever member.

In the terminal connecting mechanism for the molded case circuit breaker according to the present invention, the lever member comprises a wire receiving portion for receiving a wire on a lower surface and the wire receiving portion is comprised of a concave groove portion or "V" type groove portion formed to be concaved upwardly, insertion of the wire can easily be performed in a state that the lower surface of the lever member is pressurized and the exact insertion position can be obtained.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, such metes and bounds are therefore intended to be embraced by the appended claims.

What is claimed is:

1. A terminal connecting mechanism for a molded case circuit breaker, comprising:

a supporter that has a through hole portion for allowing passing through of a terminal of the molded case circuit breaker and a terminal seat portion where the terminal, which has passed through the through hole portion, is mounted;

a spring that one end of the spring is supported by the supporter; and a lever member that is in contact with the other end of the spring, rotatable to a position for allowing insertion of a wire to contact the terminal, and pressurizes the wire by means of an elastic force of the spring to maintain a contact state between the wire and the terminal, wherein the lever member has a spring supporting seat portion for supporting the other end of the spring, the supporter has a spring supporting seat portion for supporting one end of the spring, and the spring supporting seat portion of the supporter is located at a height higher than a height of the spring supporting seat portion of the lever member at an assembly state.

2. The terminal connecting mechanism for the molded case circuit breaker according to claim 1, wherein the lever member comprises a manipulation protruding portion formed to be more protruded toward the front than the other front portions of the lever member.

3. The terminal connecting mechanism for the molded case circuit breaker according to claim 1, wherein the lever member comprises a plurality of grooved portions at an upper portion of one surface.

4. The terminal connecting mechanism for the molded case circuit breaker according to claim 1, wherein the lever member comprises a surface having the spring supporting seat portion, which has a first inclined surface of an upper portion and a second inclined surface of a lower portion based on the spring supporting seat portion, and the first inclined surface and the second inclined surface are formed concavely toward the spring supporting seat portion.

5. The terminal connecting mechanism for the molded case circuit breaker according to claim 1, wherein the supporter comprises:

the terminal seat portion that provides a mounting space for the terminal and has a bottom portion and both sidewall portions formed to be extended from both sides of the bottom portion at a predetermined height;

a vertical wall portion that is formed to be upwardly extended from the rear of the bottom portion and has a spring supporting seat portion for supporting one end of the spring at a predetermined position; and the through hole portion that is provided at the vertical wall portion and allows passing through of the terminal.

6. The terminal connecting mechanism for the molded case circuit breaker according to claim 1, wherein the supporter further comprises a pair of extension protrusions that are provided to be extended from both sidewall portions of the terminal seat portion towards the facing sidewall portions to prevent the lever member from being detached from the supporter.

7. The terminal connecting mechanism for the molded case circuit breaker according to claim 1, wherein the lever member comprises a wire receiving portion that receives a wire on a lower surface and the wire receiving portion is configured with a concave groove portion or "V" type groove portion formed to be concaved upwardly.

* * * * *